United States Patent [19]

Löffler et al.

[11] Patent Number: 4,996,455

[45] Date of Patent: Feb. 26, 1991

[54] INDUCTIVE ENERGY CONVERTER WITH SPACED WINDING CONTACTS

[75] Inventors: Markus Löffler, Unterluss; Ulrich Braunsberger, Lengende, both of Fed. Rep. of Germany

[73] Assignees: TZN Forschungs-und Entwicklungszentrum Unterluss GmbH, Unterluss; Rheinmetall GmbH, Düsseldorf, both of Fed. Rep. of Germany

[21] Appl. No.: 480,500

[22] Filed: Feb. 16, 1990

[30] Foreign Application Priority Data

Feb. 18, 1989 [DE] Fed. Rep. of Germany ..... 3905059

[51] Int. Cl.[5] ..... F41E 1/00; G05B 24/02; H02K 3/04

[52] U.S. Cl. ..... 310/12; 310/71; 310/208; 318/135

[58] Field of Search ..... 310/12, 71, 200, 208, 310/239, 261, 13; 318/135; 320/1; 89/8; 124/3

[56] References Cited

U.S. PATENT DOCUMENTS 2,870,675 1/1959 Salisbury ..... 89/8
4,431,960 2/1984 Zucker ..... 323/340

OTHER PUBLICATIONS

Hawke, R. S.; Results of Railgun Experiments Powdered by Magnetic Flux Compression Generators, IEEE Trans. on Magnetics, vol. 18-1, (1982), pp. 82-93.

*Primary Examiner*—Steven L. Stephan
*Assistant Examiner*—D. L. Rebsch
*Attorney, Agent, or Firm*—Spencer & Frank

[57] ABSTRACT

An inductive energy converter includes a coil assembly having coil windings, with at least some of the coil windings respectively having spaced contact regions. A contact bar within the coil assembly is insulated from the coil windings, and a conductive body is in electrical contact with the contact bar and is movably supported by the coil assembly, wherein movement of the conductive body brings it into electrical contact with consecutive ones of the spaced contact regions, to complete an electrical circuit between one of the windings and the contact bar.

18 Claims, 3 Drawing Sheets

INDUCTIVE ENERGY CONVERTER WITH SPACED WINDING CONTACTS

CROSS-REFERENCE TO RELATED APPLICATION

The present disclosure relates to the subject matter disclosed in German Application No. P 39 05 059.9 of Feb. 18th, 1989, the entire specification of which is incorporated herein by reference.

BACKGROUND OF THE INVENTION

The invention relates to an inductive energy converter having a power supply, a spool or coil assembly and a movable conductive body which, when the coil assembly is energized by the power supply, can be driven by the coil assembly. Furthermore, the invention relates to the use of this inductive energy converter as an electromagnetic gun, in which case the movable body is a projectile, and, in the case where the movable body is moving through the coil assembly when the power supply is replaced by a load, as an energy supply device to the load which is to be operated at high power for a predetermined time interval.

Prior art energy converters for direct conversion of electromagnetic energy into kinetic energy include spool and rail guns (see, for example, R.M. Ogorkiewicz "Electromagnetic rungs for Armored Tanks?" Internationale Wehrrevue 3/1986, Pages 361 and following). A disadvantage associated with spool guns is their relatively high degree of circuit complexity. A disadvantage associated with rail guns is their requirement for very large amounts of electrical current, the current required being in the mega-ampere range.

Prior art devices for direct conversion of kinetic energy into electromagnetic energy, and which are to perform at high energy and performance densities, include devices which are referred to as flux compression generators which provide electrical power by extracting kinetic energy from a moving body, the electrical power being developed by compression of magnetic flux (see, for example, R. Hawke, A. Brooks, among others, "Results of Railgun Experiments Powered by Flux Compression Generators," IEEE, Trans. on Magnetics MAG - 18 (1) 1982, Pages 82 to 93). In these generators, two conductors, through which current flows in opposite directions, are propelled toward one another using explosives, with the magnetic flux between the current conductors being compressed. This results in an increase in the energy stored by the magnetic field between the current conductors, i.e., kinetic energy is converted into electromagnetic energy. A disadvantage associated with these generators is that they are destroyed during the energy conversion process.

SUMMARY OF THE INVENTION

It is an object of the present invention to provide an energy converter of the type having a coil assembly and an electrically conductive movable body, with the energy converter having less circuit complexity, and requiring less current than the prior art devices.

The above and other objects are accomplished according to the invention in that an inductive energy converter includes:

a coil assembly having coil windings, at least some of the coil windings respectively having a plurality of spaced contact regions;

a contact bar disposed within the coil assembly and insulated from the coil windings; and a conductive body which is in electrical contact with the contact bar and which is movably supported by the coil assembly, wherein movement of the conductive body brings it into electrical contact with consecutive ones of the plurality of spaced contact regions to complete an electrical circuit between a respective one of the windings and the contact bar.

It is another object of the present invention to provide a energy converter which acts as an electromagnetic gun having a coil assembly, and a movable body propelled by the coil assembly which is a projectile.

According to a further feature of the invention, an energy supply device having a coil assembly and a load are supplied with power from a moving body which can be, for example, a projectile.

The disadvantage mentioned in the foregoing, that the generators according to the prior art are destroyed during the energy conversion process, is avoided by the energy converter according to the present invention.

The invention will be described in greater detail below with reference to an embodiment which is illustrated in the drawings.

DETAILED DESCRIPTION OF THE PREFERRED EMBODIMENT

Figure 1:
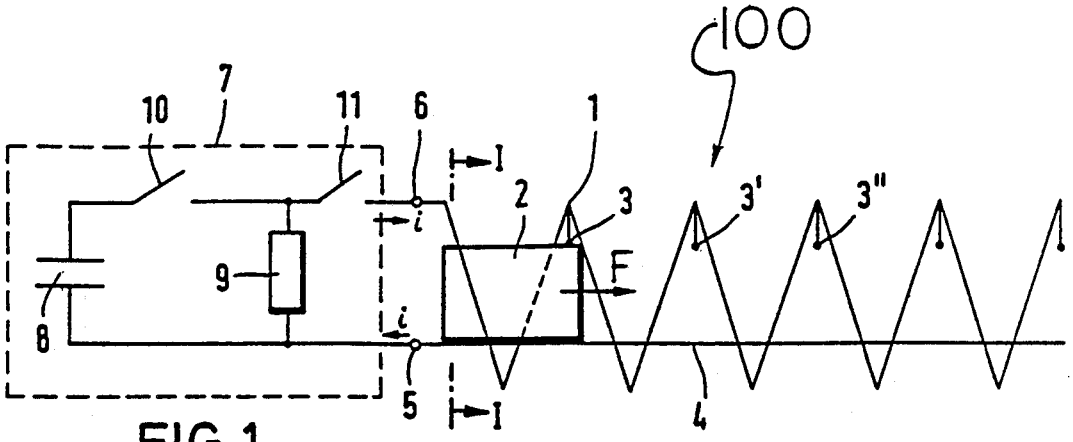
FIG. 1 is a schematic representation of an energy converter in accordance with the invention which serves as an accelerator.

An inductive energy converter 100 is shown in FIG. 1 which comprises a coil 1. A conductive body or projectile 2 is movably disposed in the coil 1 and includes at least a portion which is electrically conductive. The conductive body 2 can be formed either as a hollow body or as a solid cylinder. A plurality of contact regions 3, 3', 3'' etc., are disposed on the windings of the coil 1, and a contact bar 4 is disposed in the interior of the coil 1. An energy supply device or means 7 supplies energy to the inductive energy converter 100, and comprises a capacitor or capacitive element 8 having a capacitance $C_o$, an inductor 9 with an inductance $L_o$, and two switches 10 and 11 respectively to selectively control the transfer of energy from the capacitor 8 to the inductor 9 and to selectively control the supply of energy from the energy supply means 7 to the coil 1. A pair of connections 5 and 6 electrically connect the energy supply means 7 to the coil 1 and to the contact bar 4.

FIG. 1 illustrates a starting position of the conductive body 2 within the coil 1, in which the conductive body 2 is within the first winding of the coil 1. The first contact region 3 is disposed at the first winding of the coil 1, and the conductive body 2 is in electrical contact with the contact bar 4. The winding of the coil 1 is magnetically well coupled to the conductive body 2. The capacitor battery 8 having the capacitance $C_o$ is charged to a voltage $U_o$. The capacitor 8 in this case stores an amount of electrical energy equal to $\frac{1}{2}\cdot C_o\cdot U_o^2$.

Subsequent to closing of the switch 10 at a time t=0, the capacitor 8 discharges into the inductance 9. The time t at which the capacitor 8 is completely discharged is calculated as follows:

$$t = t_1 = \pi/2 \cdot \sqrt{L_o \cdot C_o}$$

Figure 4:
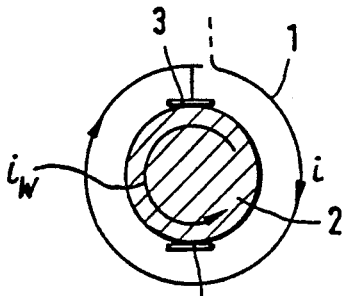
FIG. 4 is a schematic cross sectional view taken along line I—I of FIG. 1, illustrating a movable body and a coil assembly of the energy converter according to FIGS. 1-3.

At this time t, an amount of energy equal to a value $W_O$ is contained in the inductor 9. At this time t, the switch 10 is opened and simultaneously the switch 11 is closed, to supply energy to the coil 1. The inductor 9 supplies an amount of current i as shown in FIG. 1 to the first winding of the coil 1 via a conductive path formed by the connection 6, the contact region 3 of this winding, the conductive body 2, the contact bar 4, and the connection 5. Added to, i.e. superimposed upon, the current i flowing through the conductive body 2 is an eddy current $i_w$ which circulates through the conductive portion of the conductive body 2, as indicated in FIG. 4.

Figure 2:
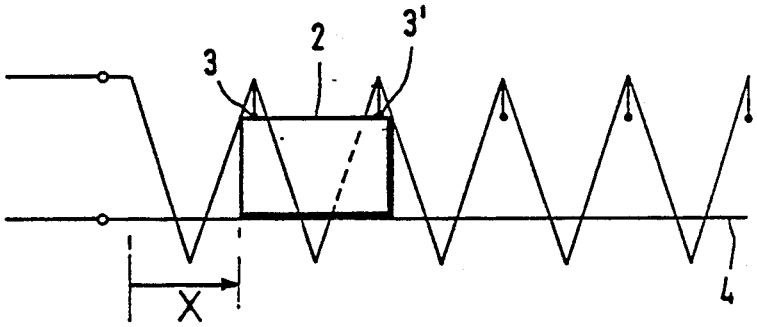
FIG. 2 is a schematic diagram of a movable body in the energy converter according to FIG. 1, at a location where current is supplied to the movable body.

Due to a tight magnetic coupling existing between the conductive body 2 and the coil 1, the flowing eddy current $i_w$ is approximately equally as strong as the current i in the coil 1 but flows in the opposite rotational direction to the current i which flows in the winding of the coil 1. This edgy current $i_w$ is induced in the conductive body 2 in accordance with Lenz's law known from electromagnetic theory, and is superimposed on the current i as described above. Because the winding current i and the eddy current $i_w$ have opposite rotational directions, a force F is generated between the coil 1 and the conductive body 2 which—as in a coil gun—accelerates the conductive body 2 to the right as seen in FIG. 1, in the direction of an opening (not shown) at the end of the coil 1. When the conductive body 2 reaches the contact region 3' of the second winding of the coil 1, as illustrated in FIG. 2, a current i starts flowing through the second winding as well. Upon further movement of the conductive body 2 to the right—as shown in FIG. 3—the connection between the contact region 3 and the contact bar 4 (via the conductive body 2) is interrupted.

Figure 3:
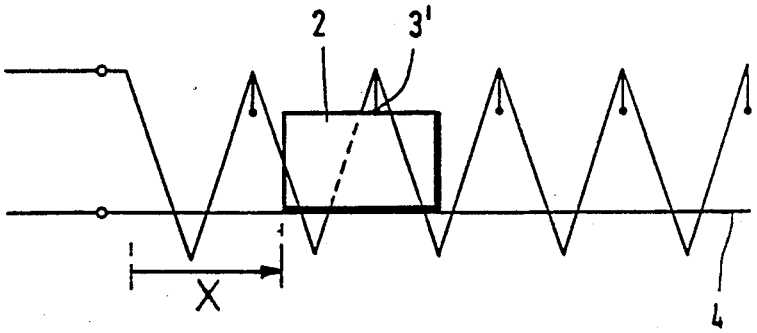
FIG. 3 is a schematic diagram of a movable body in the energy converter at a location where current supplied to the movable body is interrupted.

The current i continues to flow through the first winding in the position illustrated in FIG. 3. By the travel of the conductive body 2 to the contact region 3', and without the necessity for additional switches such as are required for the above-mentioned prior art coil guns, the current i is supplied to the second winding. The second winding has a very low net inductance because of the great counter-induction caused by the interaction between the conductive body 2, acting as a short circuiting member and having the eddy current $i_w$, and the windings at the contact region 3'. During this process, the eddy current $i_w$ and the force F are maintained on the conductive body 2. The abovedescribed process is repeated at each further one of the windings as contact is made by the conductive body 2 at the further regions 3'', etc., until the conductive body 2 leaves the coil 1 at its opening.

The following analysis demonstrates the current requirement of this energy converter when used to accelerate the movable body 2, which is seen to be significantly lower than the electrical current requirement for rail guns.

If dissipative energies (ohmic heat loss, frictional loss, commutation loss due to magnetic field scattering, etc.) are neglected, the energy balance of the energy converter 100 is represented by the following relationship:

$$W_o = \tfrac{1}{2}L\ X\cdot i^2 - M\cdot i\cdot i_w^2 + W_{kin} \qquad \text{(Equation 1)}$$

Here, L(x) is the total inductance of the portion of the energy converter 100 having the current i flowing therethrough when the conductive body 2 is at a distance x along the coil 1, and is determined from the following equation, in which $L(x)=L_o+L_s(x)$, M is the approximately constant counter-inductance between the conductive body 2 and the coil 1, $L_2$ is the inductance of the conductive body 2, and $W_{kin}$ is the kinetic energy of the conductive body 2.

The inductance $L_s$ of the portion of coil 1 through which the current i flows, this portion being assumed to be long for the purpose of the following calculation, is approximately:

$$L_s = \mu_o\cdot w^2(x)\cdot A/x \qquad \text{(Equation 2)}$$

where $\mu_o$ is the magnetic permeability constant and is equal to $4\pi\cdot 10^{-7}$H/m , x is the distance of conductive body 2 along the coil 1, w(x) is the number of the windings of coil 1 through which the current runs (this term being squared as indicated in Equation (2) above), and A is the cross sectional area—transverse to the direction of travel of the conductive body—of the interior of the coil 1.

The follow equation is used to determine the number of windings w(x):

$$w(x) = N\cdot x/\lambda \qquad \text{(Equation 3)}$$

where the number N represents the total number of all of the windings in the coil 1, and λ is the total length of the coil 1. The total inductance L(x) of the portion of the energy converter 100 through which the current i runs, based upon Equations (2) and (3), is approximately:

$$L(x) = L_o + L_s = L_o + \mu_o\cdot N^2\cdot A/\lambda\cdot x/\lambda \qquad \text{( Equation 4)}$$

As demonstrated in Equations (5)-(7) hereunder, in which Equation (4) is inserted into the energy balance of Equation (1) and a partial differentiation performed on the resultant equation with respect to the variable x, a value L' is determined which can be compared with that for rail guns, and demonstrates that a very effective magnetic coupling can be obtained according to the invention between the conductive body 2 and the corresponding windings of the coil 1 with a reduced current requirement as compared with that for rail guns:

$$W_{kin} = \int F \cdot dx \qquad \text{(Equation 5)}$$

The amount of force F on the conductive body 2 is determined from the formula:

$$F = \tfrac{1}{2} \cdot \delta L / \delta x \cdot i^2 \qquad \text{(Equation 6)}$$

The term $\delta L/\delta x$ in Equation (6) can be obtained by differentiating Equation (4) with respect to the variable x, as follows:

$$\delta L/\delta x = \mu_o \cdot N^2 \cdot A/\lambda^2 = L' \qquad \text{(Equation 7)}$$

Equation (6) applies to rail guns as well as to the energy converter 100. In rail guns L' is, as a rule, approximately 0.5 $\mu$H/m. In the energy converter 100 operating as an accelerator as described in the foregoing and having a caliber corresponding to a cross sectional diameter of 120 mm, an area $A = 1.12\ 10^{-2}\ m^2$, a length $\lambda = 7$ m, and a number of windings $N = 350$, application of the foregoing equations yields the value $L' = 35.5 \mu H/m$. By comparison with the above-mentioned value of L' for rail guns of approximately 0.5 $\mu$H/m, it can be seen that in the present invention, in order to effect the same force on the conductive body 2 which is to be accelerated in the same manner as in rail guns, only approximately one eighth of the current supply is required.

Figure 6:
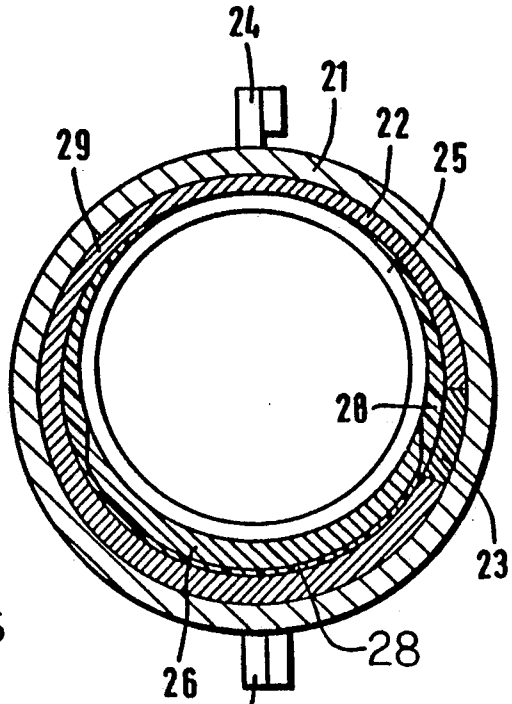
FIG. 6 is a sectional end view of the coil assembly taken along line II—II of FIG. 5, showing an end elevational view of the projectile.
Figure 5:
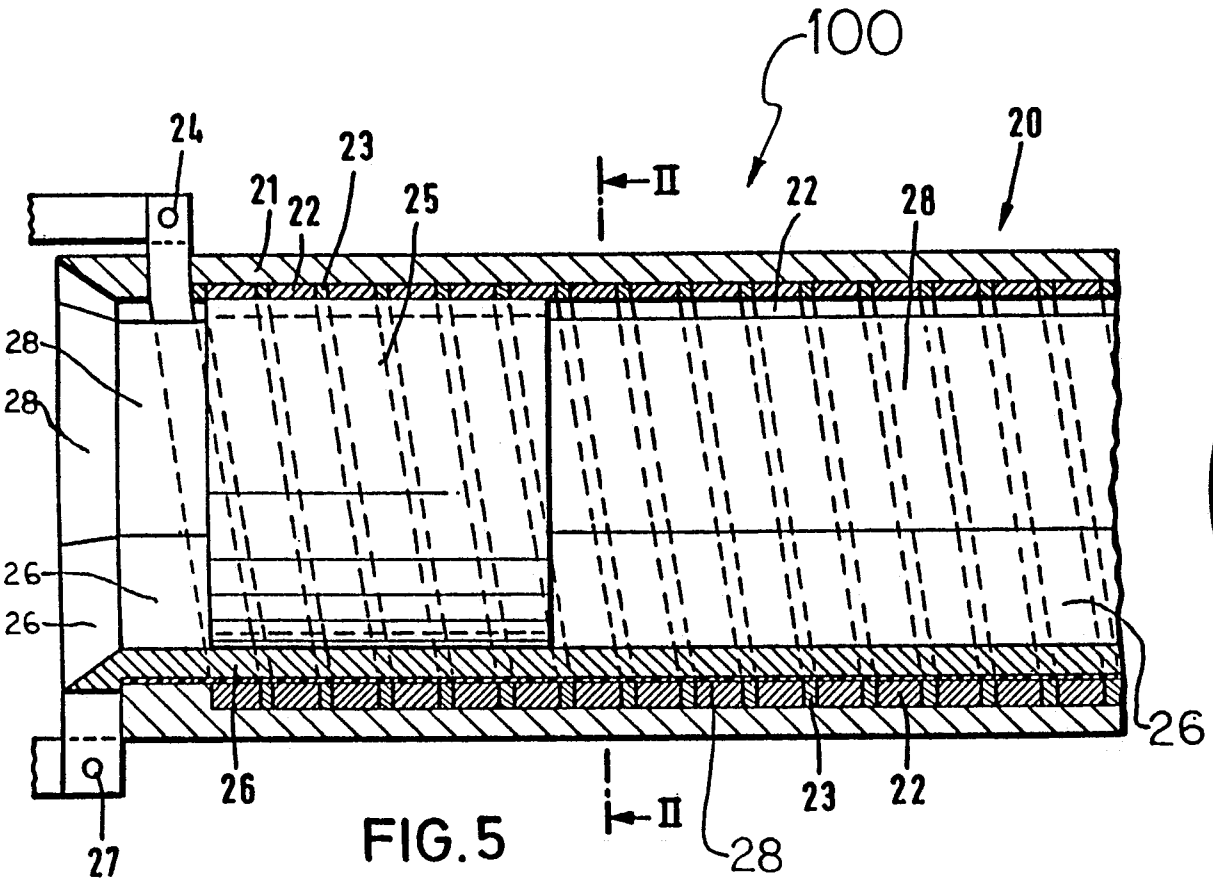
FIG. 5 is a longitudinal side sectional view of a coil assembly containing a projectile according to the invention.

An energy converter 110 in FIG. 5 includes a spool or coil assembly 20—shown in side sectional view—and a projectile 25—shown in elevational view—which is contained in the coil assembly 20. The coil assembly 20 includes electrically conductive coil windings 22 supported by an electrically insulating tube 21 composed of a fiberreinforced material. A winding 23 composed of an insulating material is disposed between the coil windings 22. A connection 24 connects the coil windings 22 to an energy supply such as the energy supply 7 of FIG. 1, and corresponds to the coil connection 6 illustrated in FIG. 1. A conductive body 25 is disposed in the interior of the coil assembly 20, and can, for example, be in the form of a ring projectile as is illustrated in FIGS. 5 and 6. A contact bar 26 is disposed at the bottom of the interior of the coil assembly 20, and is connected to the energy supply 7 by a contact bar connection 27. The contact bar 27 is insulated from the coil windings 22 by means of an intermediate insulating layer 28.

The contact regions 3, 3', 3'', etc., illustrated in FIG. 1 do not have identically corresponding elements in the embodiment of FIGS. 5 and 6. In FIGS. 5 and 6, contact is directly made between the windings 22 and the projectile 25, such that, during operation, current flows sequentially from the energy supply 7 in a path through the windings 22, the ring-shaped projectile 25, and the contact bar 26.

In a preferred embodiment of the invention, typical dimensions are as follows. The caliber of the tube 21 is 120 mm and has a wall thickness of 20 mm. The tube 21 has a length of 7mm and a number N equal to 350 (where N equals the number of windings 22), and in which the separation distance between adjacent ones of the windings 22 is approximately 0.5 cm.

Figure 7:
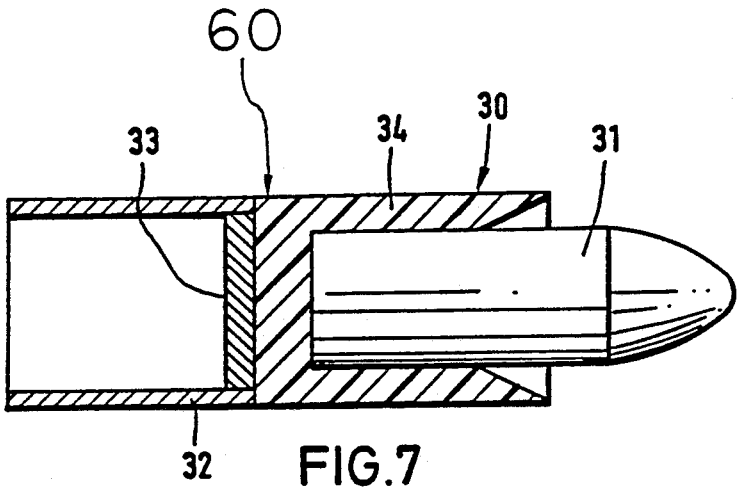
FIG. 7 is a side sectional view of a discarding sabot, and an elevational view of a projectile carried by the discarding sabot, for use in an energy converter according to the invention.

Instead of providing the conductive body 25 with the shape of a ring, it is possible, for example, to provide a missile 30 including a projectile 31 and a discardable sabot 60 as illustrated in FIG. 7. The sabot 60 carries the projectile 31 and includes a conductive member 32 which may be ring-shaped as shown, a conductive body 33, and a sabot body portion 34 which is a plastic element made of segments. The missile 30 is inserted into the accelerator. A breechblock such as is used on conventional guns is not required.

Figure 8:
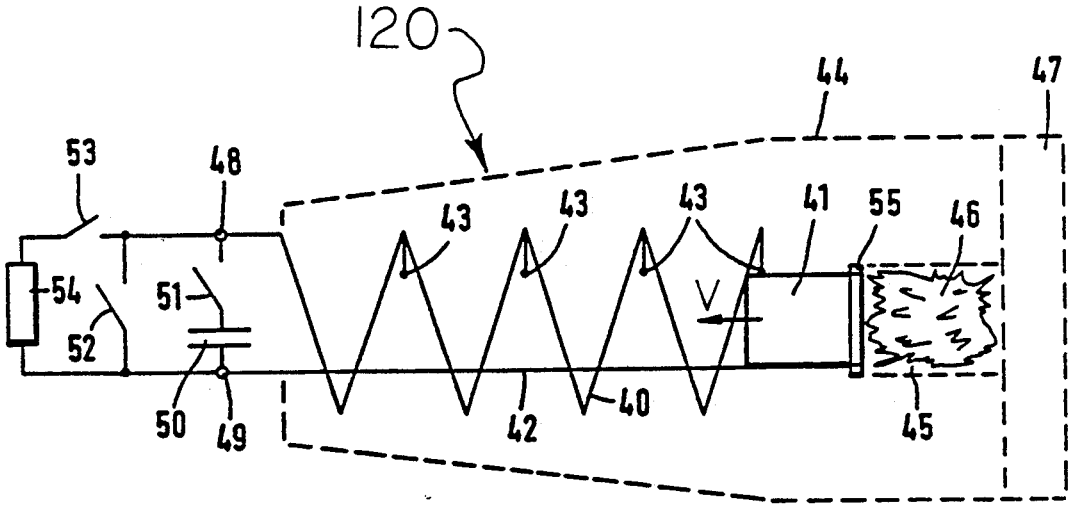
FIG. 8 is a schematic representation of an energy converter in accordance with the invention which serves as an energy supply for a load device having a high power requirement.

An energy converter 120 according to the invention is shown. in FIG. 8 configured to operate as a high level energy supply device. The energy converter 120 can, for example, be used with guns which supply to the energy converter 120 a moving body having kinetic energy which can be converted into electrical energy, and is discussed in detail as follows. The energy converter 120 includes a coil assembly 40 and a conductive body 41 disposed in the coil assembly 40. The conductive body 41 is in the form of a full cylinder which is electrically well conducting. A plurality of contact regions 43 are disposed on the coil assembly 40, and a contact bar 42 is disposed in the coil assembly 40. The entire coil assembly 40 is disposed in a pressure-resistant housing 44 indicated by dashed lines in FIG. 8, which housing 44 includes a propellant charge chamber 45 for receiving a suitable propelling charge substance 46. The propellant charge chamber 45 can be sealed at one end by the presence of the conductive body 41, and on the other end by a breech block 47. A pair of contacts 48 and 49, respectively, connect the coil assembly 40 and the contact bar 42 to a capacitor 50—which serves as an energy storage device—and to an electrical load 54. The capacitor 50 is connectable to the coil assembly 40 by a switch 51 and to the electrical load 54 by switch 53. A switch 52 can connect the contacts 48 and 49. The load device 54 in a preferred embodiment is of a type which has a high electrical energy requirement.

At the start of an energy conversion process using the energy converter 120, the conductive body 41 is at the location illustrated in FIG. 8 and electrically connects a rightmost one of the contact regions 43, which is at the last winding of the coil assembly 40, with the contact bar 42. The capacitor battery 50 at this time is loaded to a voltage $U_O$ and stores an amount of energy $W_O$.

At the time $t=0$, the switch 51 is closed, thereby connecting the capacitor battery 50 across the connections 48 and 49, so that the capacitor battery 50 causes current to flow through the coil assembly 40, the contact region 43 at the last winding of the coil assembly 40, the conductive body 41, and the contact bar 42, thereby causing a magnetic field to be generated by the coil assembly 40. As a result of the magnetic field generated by the coil assembly 40, an eddy current is induced in the conductive body 41 in accordance with Lenz's law which is in an opposite direction from the direction of current in the coil windings 42. The eddy current produces a magnetic field which is opposed to the magnetic field of the coil assembly 40 through which the current flows.

At the position of the conductive body 41 shown in FIG. 8, only a small force is exerted on the conductive body 41 urging it in the direction of the breech block 47. The conductive body 41 is blocked by a ring 55 which is recessed in the housing 44 and which prevents movement of the conductive body 41 toward the breechblock 47. Upon completion of discharge of the capacitor battery 50, substantially the entire amount of energy $W_O$ originally stored in the capacitor battery is in the coil assembly 40 which uses the energy to create its magnetic field. The propelling charge substance 46 is then ignited, at a time $t=t_1$.

At the time $t=t_1$, the switch 51 is opened and the switch 52 is closed, thereby short-circuiting the coil assembly 40 and the contact bar 42. The propelling charge substance 46 produces a high pressure gas which propels the conductive body 41 toward the left in FIG. 8 through the coil assembly 40, in the direction indicated by an arrow labelled V in FIG. 8. The processes involved in the energy converter 120 described in the foregoing correspond in principle to the processes involved in the energy converter 100 shown in FIG. 1, but in a reversed order as discussed further in the following.

Energy is supplied to the coil assembly 40 from the conductive body 41 by interaction of the magnetic field generated in the windings of the coil assembly 40 and the magnetic field generated by the eddy current in the conductive body 41. The current in the coil assembly 40 generates the magnetic field which causes a force to be exerted on the conductive body 41 which is in the opposite direction from the direction V of movement of the conductive body 41. As a result of this movement of the conductive body 41, the current through the coil assembly 40 increases since its inductance becomes progressively smaller as the conductive body 41 passes to the left, since the current flowing through the windings of the coil assembly 40 passes through fewer and fewer windings. The result is that the magnetic field in the coil assembly is compressed, thereby storing energy in the magnetic field of the coil assembly while simultaneously slowing speed of the conductive body 41.

At a time $t=t_2$, which is after the time $t=t_1$ and which is before the conductive body 41 reaches the leftmost winding of the coil assembly 40, the switch 52 is opened and the switch 53 closed. As a result, the current which was passing across the closed switch 52 is diverted instead to the load device 54. The energy-filled coil assembly 40 then discharges at a high rate into the load device 54.

The energy converter 120 can be designed so that the conductive body 41 is decelerated by the resistance caused by the magnetic field of the coil assembly 40 such that the conductive body 41 is slowed to a speed which is sufficiently low, prior to exiting coil assembly 40, that it can be collected and re-used.

The structural design of the energy converter 120 illustrated in FIG. 8 is for operation as a "high performance energy supply." In this embodiment, which includes a structure of the coil assembly 40 which corresponds substantially to the design shown in FIGS. 5 and 6, the conductive body 41 is designed as a well-conducting full cylinder of copper, which is coated on its surface with an arc-proof material (for example, a copper-tungsten alloy).

It will be understood that the above description of the present invention is susceptible to various modifications, changes and adaptations, and the same are intended to be comprehended within the meaning and range of equivalents of the appended claims.

What is claimed is:

1. An inductive energy converter, comprising:

a coil assembly having coil windings, at least some of said coil windings respectively having a plurality of spaced contact regions;

a contact bar disposed within said coil assembly and insulated from said coil windings; and a conductive body which is in electrical contact with said contact bar and which is movably supported by said coil assembly, wherein movement of said conductive body brings it into electrical contact with consecutive ones of said plurality of spaced contact regions to complete an electrical circuit between a respective one of said windings and said contact bar.

2. An inductive energy converter as claimed in claim 1, further comprising an electrical energy supply for supplying energy to said coil windings to generate a magnetic field in said coil assembly causing motion of said conductive body.

3. An inductive energy converter as claimed in claim 2, wherein said conductive body has a configuration as a projectile

4. An inductive energy converter as claimed in claim 2, wherein said conductive body is configured as a ring projectile.

5. An inductive energy converter as claimed in claim 2, wherein said conductive body is configured as a discardable sabot projectile.

6. An inductive energy converter as claimed in claim 2, wherein said coil assembly includes a supporting tube in which said coil windings surround a tubular region, and an insulating body is disposed between said coil windings and said contact bar.

7. An inductive energy converter as claimed in claim 6, wherein said conductive body has an outer diameter which closely conforms to an inner diameter of said tubular region.

8. An inductive energy converter as claimed in claim 6, wherein said coil assembly supports said conductive body within said tubular region.

9. An inductive energy converter as claimed in claim 6, wherein said coil assembly is relatively long in comparison to the inner diameter of said tubular region.

10. An inductive energy converter as claimed in claim 6, wherein said conductive body has a substantially cylindrical outer portion.

11. An inductive energy converter as claimed in claim 6, wherein said conductive body includes a sabot body portion having an outer diameter adapted to be received in said tubular region, a projectile supported by said sabot body portion, a conductive cage connected to said sabot body portion, and a disk-shaped conductive member electrically connected to said conductive cage.

12. An inductive energy converter as claimed in claim 11, wherein said sabot body portion is composed of plastic.

13. An inductive energy converter as claimed in claim 1, further comprising an energy supply for supplying energy initially to said coil assembly to generate a magnetic field in said coil assembly, means for imparting a relatively high kinetic energy to said conductive body such that when said energy supply is removed from said coil assembly, kinetic energy from said conductive body is converted into energy stored in the magnetic field of said coil assembly to supply energy to a load having a relatively high energy capacity.

14. An inductive energy converter as claimed in claim 13, further comprising a pressure-resistant housing surrounding said coil assembly, said housing including a propellantcharge chamber having two ends and which is open at one end to a tubular region of said coil assembly, and a breechblock for covering the other end of said chamber, wherein said conductive body is disposed at the other end of said chamber at one end of said tubular region.

15. An inductive energy converter as claimed in claim 14, wherein said means for imparting comprises a propelling charge disposed between said conductive body and said breechblock for propelling said conductive body through said tubular region.

16. An inductive energy converter as defined in claim 2 wherein said contact regions are spaced by a length which is less than the length of said conductive body.

17. An inductive energy converter as defined in claim 6 wherein said contact regions are spaced by a length which is less than the length of said conductive body.

18. An inductive energy converter as defined in claim 14 wherein said contact regions are spaced by a length which is less than the length of said conductive body.

* * * * *